US006036136A

United States Patent [19]

Bobo

[11] Patent Number: 6,036,136

[45] Date of Patent: Mar. 14, 2000

[54] PORTABLE BOBBIN WINDER

[76] Inventor: Betty Bobo, 3159 Estes St., Memphis, Tenn. 38115

[21] Appl. No.: 09/057,756

[22] Filed: Apr. 9, 1998

[51] Int. Cl.[7] ..... B65H 54/00

[52] U.S. Cl. ..... 242/485.7; 242/484.8; 242/486.8; 242/905

[58] Field of Search ..... 242/485.8, 485.7, 242/486.8, 905, 400, 484.8

[56] References Cited

U.S. PATENT DOCUMENTS

| | | | |
|---|---|---|---|
| 223,133 | 12/1879 | Hall, Jr. | 242/139 X |
| 2,465,466 | 3/1949 | Mitchell | 242/400 X |
| 4,096,812 | 6/1978 | Gegauf | 242/484.8 X |
| 4,588,139 | 5/1986 | Lines | 242/484.8 X |
| 4,646,982 | 3/1987 | Spring | 242/484.8 |
| 4,979,688 | 12/1990 | Tinker et al. | 242/486.8 |
| 5,707,021 | 1/1998 | Bitts et al. | 242/139 |
| 5,865,394 | 2/1999 | Giese et al. | 242/485.7 |

*Primary Examiner*—Michael R. Mansen

[57] ABSTRACT

A new portable bobbin winder for winding a quantity of thread around a bobbin without stopping work on a sewing machine. The inventive device includes a base member having a hollow interior. A motor is secured within the hollow interior of the base member. A fixed thread spindle extends upwardly from the base member. The fixed thread spindle receives a spool of thread thereon. A thread feed is coupled with the base member in an operative orientation. The thread feed includes an elongated shaft having a looped upper end for receiving thread therethrough. A cylindrical tension guide is coupled with the base member inwardly of the fixed thread spindle. A rotatable bobbin spindle extends inwardly of the base member and couples with the motor. The bobbin spindle receives a bobbin thereon.

17 Claims, 2 Drawing Sheets

PORTABLE BOBBIN WINDER

BACKGROUND OF THE INVENTION

1. Field of the Invention

The present invention relates to bobbin winders and more particularly pertains to a new portable bobbin winder for winding a quantity of thread around a bobbin without stopping work on a sewing machine.

2. Description of the Prior Art

The use of bobbin winders is known in the prior art. More specifically, bobbin winders heretofore devised and utilized are known to consist basically of familiar, expected and obvious structural configurations, notwithstanding the myriad of designs encompassed by the crowded prior art which have been developed for the fulfillment of countless objectives and requirements.

Known prior art bobbin winders include U. S. Pat. No. 5,431,353 to Horler; U.S. Pat. No. 5,297,748 to LeCompte; U.S. Pat. No. 4,948,058 to Behrens et al.; U.S. Pat. No. 4,627,583 to Huemer; U.S. Pat. No. 4,332,065 to Hauri; and U.S. Pat. No. Des. 246,785 to Abe et al.

While these devices fulfill their respective, particular objectives and requirements, the aforementioned patents do not disclose a new portable bobbin winder. The inventive device includes a base member having a hollow interior. A motor is secured within the hollow interior of the base member. A fixed thread spindle extends upwardly from the base member. The fixed thread spindle receives a spool of thread thereon. A thread feed is coupled with the base member in an operative orientation. The thread feed includes an elongated shaft having a looped upper end for receiving thread therethrough. A cylindrical tension guide is coupled with the base member inwardly of the fixed thread spindle. A rotatable bobbin spindle extends inwardly of the base member and couples with the motor. The bobbin spindle receives a bobbin thereon.

In these respects, the portable bobbin winder according to the present invention substantially departs from the conventional concepts and designs of the prior art, and in so doing provides an apparatus primarily developed for the purpose of winding a quantity of thread around a bobbin without stopping work on a sewing machine.

SUMMARY OF THE INVENTION

In view of the foregoing disadvantages inherent in the known types of bobbin winders now present in the prior art, the present invention provides a new portable bobbin winder construction wherein the same can be utilized for winding a quantity of thread around a bobbin without stopping work on a sewing machine.

The general purpose of the present invention, which will be described subsequently in greater detail, is to provide a new portable bobbin winder apparatus and method which has many of the advantages of the bobbin winders mentioned heretofore and many novel features that result in a new portable bobbin winder which is not anticipated, rendered obvious, suggested, or even implied by any of the prior art bobbin winders, either alone or in any combination thereof.

To attain this, the present invention generally comprises a base member having a generally rectangular configuration. The base member includes an upper wall, a bottom wall, long opposed side walls, short opposed end walls, and a hollow interior. The upper wall includes an aperture and an elongated slot therethrough. The base member includes a cover member removably disposed over the upper wall thereof. The cover member includes a handle pivotally secured to an upper surface thereof. The base member and the cover member have corresponding latch members to facilitate securement of the cover member to the base member. A motor is secured within the hollow interior of the base member. The motor has a power cord extending outwardly of the base member for coupling with an electrical outlet. The motor includes a power switch disposed within the upper wall of the base member. A cord harness is secured within the hollow interior of the base member. The cord harness stores excess length of the power cord when not in use. A fixed thread spindle extends upwardly from the upper wall of the base member inwardly of the aperture therethrough. The fixed thread spindle receives a spool of thread thereon. A thread feed is coupled with the aperture of the upper wall of the base member in an operative orientation. The thread feed includes an elongated shaft having a looped upper end for receiving thread therethrough. A cylindrical sleeve is secured to the upper wall of the base member for receiving the elongated shaft therein in a non-operative orientation. A cylindrical tension guide is coupled with the upper wall of the base member inwardly of the fixed thread spindle. A rotatable bobbin spindle extends inwardly of the elongated slot of the upper wall of the base member and couples with the motor. The bobbin spindle receives a bobbin thereon. A bobbin stop is positioned adjacent to the bobbin spindle.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein arc for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new portable bobbin winder apparatus and method which has many of the advantages of the bobbin winders mentioned heretofore and many novel features that result in a new portable bobbin winder which is not anticipated, rendered obvious, suggested, or even implied by any of the prior art bobbin winders, either alone or in any combination thereof.

It is another object of the present invention to provide a new portable bobbin winder which may be easily and efficiently manufactured and marketed.

It is a further object of the present invention to provide a new portable bobbin winder which is of a durable and reliable construction.

An even further object of the present invention is to provide a new portable bobbin winder which is susceptible of a low cost of manufacture with regard to both materials and labor, and which accordingly is then susceptible of low prices of sale to the consuming public, thereby making such portable bobbin winder economically available to the buying public.

Still yet another object of the present invention is to provide a new portable bobbin winder which provides in the apparatuses and methods of the prior art some of the advantages thereof, while simultaneously overcoming some of the disadvantages normally associated therewith.

Still another object of the present invention is to provide a new portable bobbin winder for winding a quantity of thread around a bobbin without stopping work on a sewing machine.

Yet another object of the present invention is to provide a new portable bobbin winder which includes a base member having a hollow interior. A motor is secured within the hollow interior of the base member. A fixed thread spindle extends upwardly from the base member. The fixed thread spindle receives a spool of thread thereon. A thread feed is coupled with the base member in an operative orientation. The thread feed includes an elongated shaft having a looped upper end for receiving thread therethrough. A cylindrical tension guide is coupled with the base member inwardly of the fixed thread spindle. A rotatable bobbin spindle extends inwardly of the base member and couples with the motor. The bobbin spindle receives a bobbin thereon.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
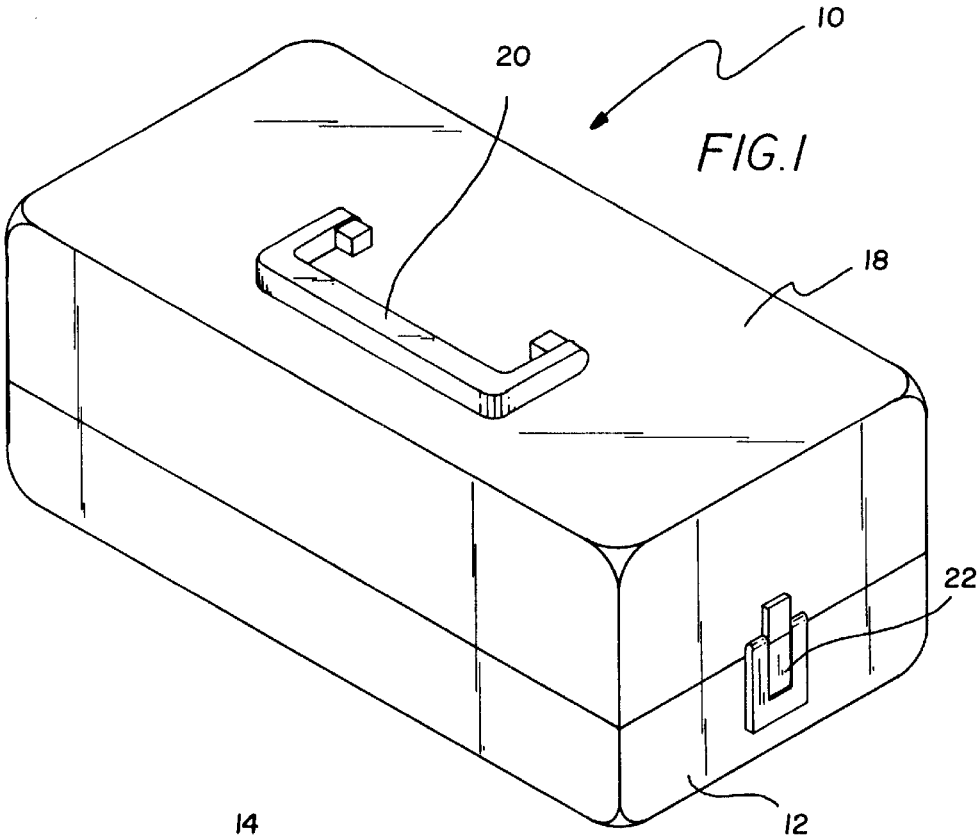
FIG. 1 is a perspective view of a new portable bobbin winder according to the present invention.
Figure 2:
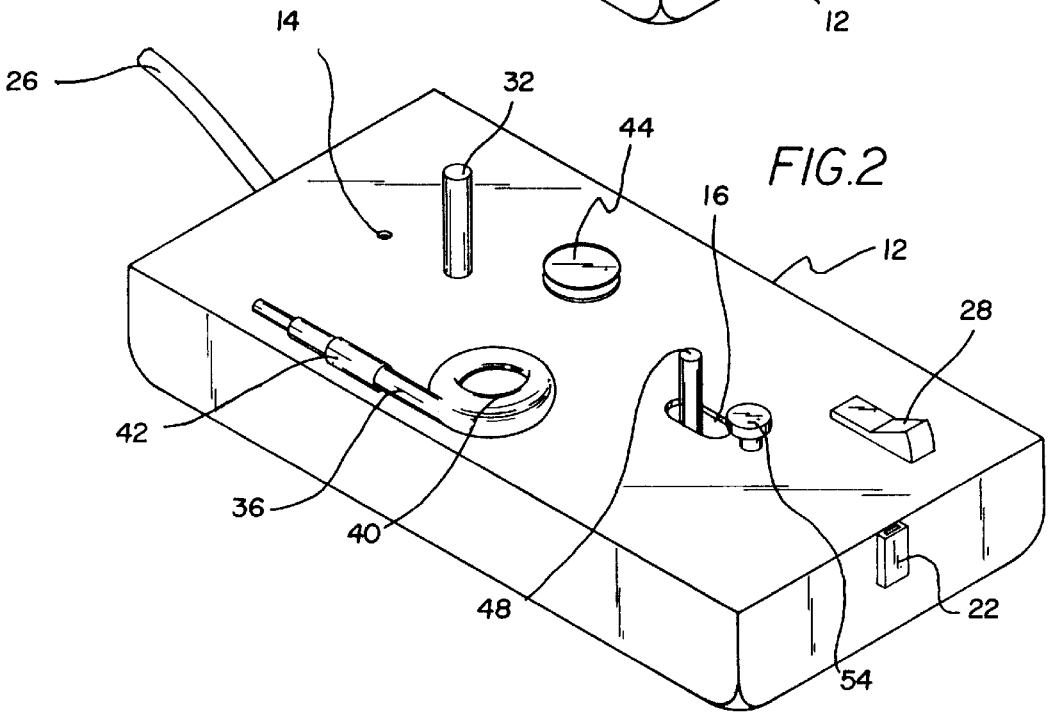
FIG. 2 is a perspective view of the base of the present invention.
Figure 3:
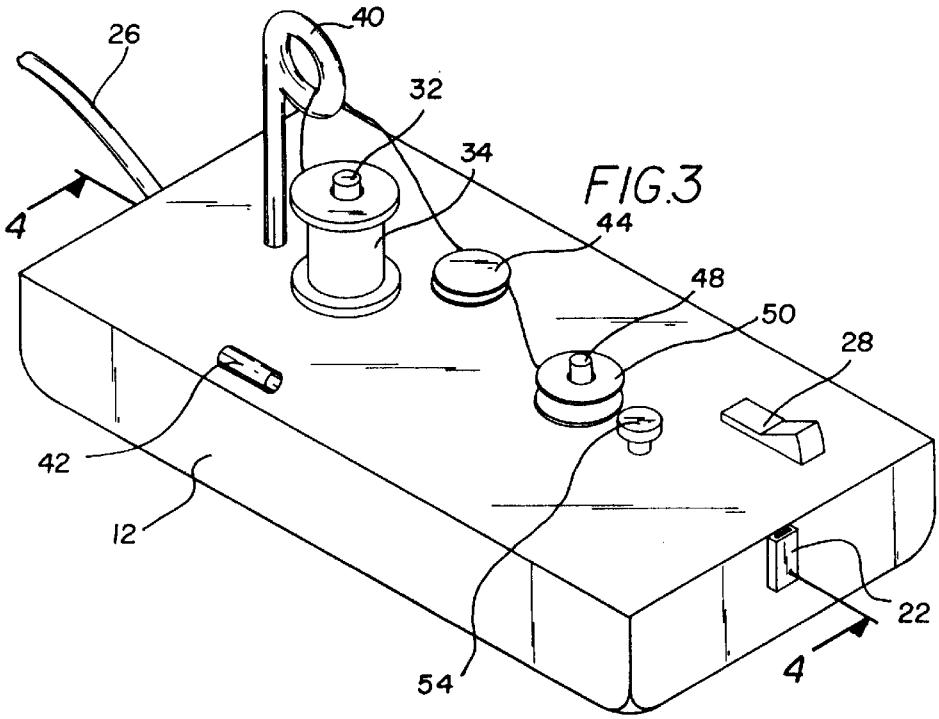
FIG. 3 is a perspective view of the present invention illustrated in use.
Figure 4:
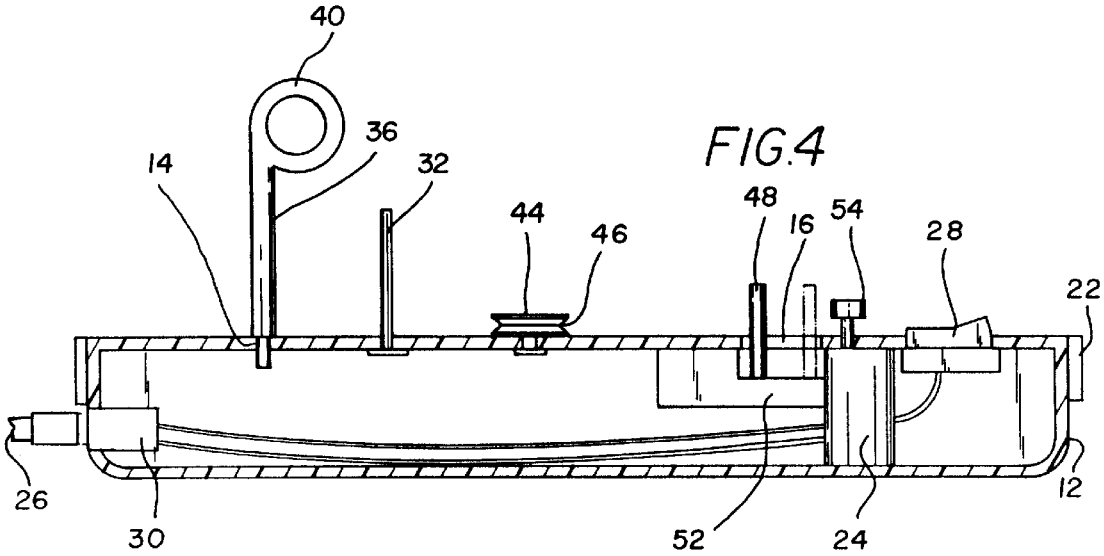
FIG. 4 is a cross-sectional view of the present invention as taken along line 4—4 of FIG. 3.

With reference now to the drawings, and in particular to FIGS. 1 through 4 thereof, a new portable bobbin winder embodying the principles and concepts of tie present invention and generally designated by the reference numeral 10 will be described.

As best illustrated in FIGS. 1 through 4, the portable bobbin winder 10 comprises a base member 12 having a generally rectangular configuration. The base member 12 includes an upper wall, a bottom wall, long opposed side walls, short opposed end walls, and a hollow interior. The upper wall includes an aperture 14 and an elongated slot 16 therethrough. The base member 12 includes a cover member 18 removably disposed over the upper wall thereof. The cover member 18 includes a handle 20 pivotally secured to an upper surface thereof. The base member 12 and the cover member 18 have corresponding latch members 22 to facilitate securement of the cover member 18 to the base member 12. Note FIGS. 1 and 2.

A motor 24 is secured within the hollow interior of the base member 12. The motor 24 has a power cord 26 extending outwardly of the base member 12 for coupling with an electrical outlet. The motor 24 includes a power switch 28 disposed within the upper wall of the base member 12. Alternately, the motor 24 could be powered by batteries or the like.

A cord harness 30 is secured within the hollow interior of the base member 12. The cord harness 30 stores excess length of the power cord 26 when not in use.

A fixed thread spindle 32 extends upwardly from the upper wall of the base member 12 inwardly of the aperture 14 therethrough. The fixed thread spindle 32 receives a spool of thread 34 thereon.

A thread feed 36 is coupled with the aperture 14 of the upper wall of the base member 12 in an operative orientation. Note FIG. 3. The thread feed 36 includes an elongated shaft having a looped upper end 40 for receiving thread therethrough. A cylindrical sleeve 42 is secured to the upper wall of the base member 12 for receiving the elongated shaft therein in a non-operative orientation. Note FIG. 2. The elongated shaft includes a lower segment of a reduced diameter for being received within the aperture 14 of the base member 12.

A cylindrical tension guide 44 is coupled with the upper wall of the base member 12 inwardly of the fixed thread spindle 32. The tension guide 44 includes a channel 46 formed between upper and lower circular plates. The channel 46 serves to guide the thread therethrough. Note FIG. 3.

A rotatable bobbin spindle 48 extends inwardly of the elongated slot of the upper wall of the base member. The rotatable bobbin spindle is operationally coupled to the motor and is designed to receive a bobbin thereon.

A bobbin stop 54 is positioned adjacent to the bobbin spindle 48. The bobbin stop 54 includes an upper circular section and a tubular shaft.

In use, the sewer would place a spool of thread 34 onto the fixed thread spindle 32. Next, the thread would be inserted through the looped upper end 40 of the thread feed 36 and the tension guide 44. The thread would then be wrapped around the bobbin 50 several times and placed on the rotatable bobbin spindle 48. The power switch 28 would then be turned on to facilitate rotation of the bobbin spindle 48. Once the bobbin 50 becomes full, it would rest against the bobbin stop 54, so that it would not be overfilled. The power switch 28 would be turned off to stop the motor 24. The sewer would then cut the thread and remove the filled bobbin 50 for use.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A portable bobbin winder for winding a quantity of thread around a bobbin without stopping work on a sewing machine comprising, in combination:

a base member having a generally rectangular configuration, the base member including an upper wall, a bottom wall, long opposed side walls, short opposed end walls, and a hollow interior, the upper wall including an aperture and an elongated slot therethrough, the base member including a cover member removably disposed over the upper wall thereof, the cover member including a handle pivotally secured to an upper surface thereof, the base member and the cover member having corresponding latch members to facilitate securement of the cover member to the base member;

a motor secured within the hollow interior of the base member, the motor having a power cord extending outwardly of the base member for coupling with an electrical outlet, the motor including a power switch disposed within the upper wall of the base member;

a cord harness secured within the hollow interior of the base member, the cord harness storing excess length of the power cord when not in use;

a fixed thread spindle extending upwardly from the upper wall of the base member inwardly of the aperture therethrough, the fixed thread spindle receiving a spool of thread thereon;

a thread feed coupled with the aperture of the upper wall of the base member in an operative orientation, the thread feed including an elongated shaft having a looped upper end for receiving thread therethrough, a cylindrical sleeve secured to the upper wall of the base member for receiving the elongated shaft therein in a non-operative orientation;

a cylindrical tension guide coupled with the upper wall of the base member inwardly of the fixed thread spindle;

a rotatable bobbin spindle extending inwardly of the elongated slot of the upper wall of the base member and coupling with the motor, the bobbin spindle receiving a bobbin thereon; and a bobbin stop positioned adjacent to the bobbin spindle.

2. A portable bobbin winder for winding a quantity of thread around a bobbin without stopping work on a sewing machine comprising, in combination:

a base member having a hollow interior;

a motor secured within the hollow interior of the base member;

a fixed thread spindle extending upwardly from the base member, the fixed thread spindle receiving a spool of thread thereon;

a thread feed coupled with the base member in an operative orientation, the thread feed including an elongated shaft having a looped upper end for receiving thread therethrough;

a cylindrical tension guide coupled with the base member inwardly of the fixed thread spindle;

a rotatable bobbin spindle extending inwardly of the base member and coupling with the motor, the bobbin spindle receiving a bobbin therein.

3. The portable bobbin winder as set forth in claim 2 wherein the base member includes a cover member removably disposed over an upper wall thereof, the cover member including a handle pivotally secured to an upper surface thereof.

4. The portable bobbin winder as set forth in claim 3 wherein the base member and the cover member have corresponding latch members to facilitate securement of the cover member to the base member.

5. The portable bobbin winder as set forth in claim 2 wherein the motor includes a power switch disposed within the upper wall of the base member.

6. The portable bobbin winder as set forth in claim 2 wherein the motor has a power cord extending outwardly of the base member for coupling with an electrical outlet.

7. The portable bobbin winder as set forth in claim 6 and further including a cord harness secured within the hollow interior of the base member, the cord harness storing excess length of the power cord when not in use.

8. The portable bobbin winder as set forth in claim 2 and further including a cylindrical sleeve secured to the upper wall of the base member for receiving the elongated shaft therein in a non-operative orientation.

9. The portable bobbin winder as set forth in claim 2 and further including a bobbin stop positioned adjacent to the bobbin spindle.

10. A portable bobbin winder for winding a quantity of thread around a bobbin without stopping work on a sewing machine, the portable bobbin winder comprising:

a base member having a hollow interior;

a motor positioned in the hollow interior of the base member;

a fixed thread spindle coupled to and extending upwardly from the base member, the fixed thread spindle being adapted for receiving a spool of thread thereon;

a thread feed including an elongated shaft having a looped upper end adapted for receiving thread therethrough, the thread feed being removably couplable to the base member proximate the fixed thread spindle such that the looped upper end is positioned at an elevation relative to the base member that is higher than an elevation of a distal end of the fixed thread spindle relative to the base member;

a rotatable bobbin spindle extending through the base member and operationally coupling with the motor, the bobbin spindle being adapted for receiving a bobbin thereon; and a cylindrical tension guide coupled to the base member between the fixed thread spindle and the rotatable bobbin spindle.

11. The portable bobbin winder as set forth in claim 10 wherein the base member includes a cover member removably disposed over an upper wall thereof, the cover member including a handle pivotally secured to an upper surface thereof.

12. The portable bobbin winder as set forth in claim 11 wherein the base member and the cover member have corresponding latch members to facilitate securement of the cover member to the base member.

13. The portable bobbin winder as set forth in claim 10 wherein the motor includes a power switch disposed within the upper wall of the base member.

14. The portable bobbin winder as set forth in claim 10 wherein the motor has a power cord extending outwardly of the base member for coupling with an electrical outlet.

15. The portable bobbin winder as set forth in claim 14 and further including a cord harness secured within the hollow interior of the base member, the cord harness storing excess length of the power cord when not in use.

16. The portable bobbin winder as set forth in claim 10 and further including a cylindrical sleeve secured to the upper wall of the base member for removably coupling to the elongated shaft of the thread feed for holding the thread feed in a non-operative orientation.

17. The portable bobbin winder as set forth in claim 10 and further including a bobbin stop positioned adjacent to the bobbin spindle.

* * * * *